United States Patent [19]

Demangeon et al.

[11] Patent Number: 4,851,141

[45] Date of Patent: Jul. 25, 1989

[54] CONCENTRATED STABLE NONAQUEOUS FABRIC SOFTENER COMPOSITION

[75] Inventors: Yvon Demangeon, Gomze-Andoumont, France; Michel Julemont, Heusy; Marie-Helene Fraikin, Herstal, both of Belgium

[73] Assignee: Colgate-Palmolive Company, New York, N.Y.

[21] Appl. No.: 161,404

[22] Filed: Feb. 23, 1988

Related U.S. Application Data

[63] Continuation of Ser. No. 680,630, Dec. 12, 1984, abandoned.

[51] Int. Cl.[4] ..... D06M 13/40; D06M 13/46

[52] U.S. Cl. ..... 252/8.75; 252/8.8

[58] Field of Search ..... 252/8.75, 8.8

[56] References Cited

U.S. PATENT DOCUMENTS

| | | | |
|---|---|---|---|
| 3,395,100 | 7/1968 | Fisher et al. | 252/8.8 |
| 4,277,350 | 7/1981 | Minegishi et al. | 252/8.8 |
| 4,351,737 | 9/1982 | Billenstein et al. | 252/8.8 |
| 4,409,109 | 10/1983 | Richmond | 252/8.8 |
| 4,429,859 | 2/1984 | Steiner et al. | 252/8.8 |
| 4,454,049 | 6/1984 | MacGilp et al. | 252/8.8 |

FOREIGN PATENT DOCUMENTS 30965 2/1984 Japan .

*Primary Examiner*—Prince E. Willis

*Attorney, Agent, or Firm*—Norman Blumenkopf; Murray M. Grill

[57] ABSTRACT

Hexylene glycol alone or in combination with a lower alkanol or another glycol or glycol ether, or mixtures thereof provide a non-aqueous liquid carrier for cationic fabric softeners, especially the quaternary ammonium and imidazolinium cationic compounds, for preparing stable concentrated fabric softener compositions. The compositions may contain up to 60% by weight of the cationic compound and may additionally include up to 15% by weight of a nonionic surfactant. The concentrated compositions disperse easily in cold water and are easily dispensed from automatic dispensers.

21 Claims, No Drawings

CONCENTRATED STABLE NONAQUEOUS FABRIC SOFTENER COMPOSITION

This application is a continuation, of application Ser. No. 680,630 filed Dec. 12, 1984 now abandoned.

BACKGROUND OF THE INVENTION

The present invention relates to fabric softener compositions adapted for the use in the rinse cycle of a laundering process and in particular to highly concentrated fabric softener compositions which are easily dispersed in water when used, particularly in laundry machines having automatic dispensing mechanisms.

Compositions containing quaternary ammonium salts having at least one long chain hydrocarbyl group are commonly used to provide fabric softening benefits when employed in a laundry rinse operation; for example, see U.S. Pat. Nos. 3,349,033; 3,644,203; 3,946,115; 3,997,453; 4,073,735 and 4,119,545.

For most aqueous softener compositions containing cationic quaternary ammonium compounds as active ingredients, the concentration of such cationics has, in general, been limited to the range of about 3 to 6% by weight (see U.S. Pat. No. 3,904,533 and U.S. Pat. No. 3,920,565). Such a low concentration is generally necessitated by the fact that cationics form gels in water systems at concentrations at above about 8%, and while the use of electrolytes to lower the viscosity of such compositions is known (see in particular U.S. Pat. No. 4,199,545), such electrolytes are far from satisfactory. From a functional point of view, the electrolytes often do not perform as required particularly at concentrations of the cationics in the neighborhood of about 12–15%. Further, while the performance of the electrolytes may mitigate some of the gelling problem, their use is far from satisfactory in providing a highly concentrated aqueous system of cationics which does not gel or severely change in viscosity within the usual range of temperatures encountered in the handling thereof, for example 0° F. (about −18° C.) up to about 140° F. (about 60° C.) or in the dispensing from washing machines.

In the ordinary use of European household automatic washing machines, the user places the rinse cycle fabric softener in a dispensing unit (e.g. a dispensing drawer) of the machine. Then, in the operation of the machine, during the rinse cycle, the softener composition is subjected to a stream of cold water to transfer it to the drum. In winter, when the soften composition and the water fed to the dispenser may be especially cold, there can be problems in that some of the composition is not flushed completely off the dispenser during operation of the machine, and a deposit of the composition may build up with repeated wash cycles, so that it may become necessary for the user to flush the dispenser with hot water. This problem can be particularly severe for highly concentrated softener formulations because of the aforementioned gelling problem and also when a nonionic surfactant is present with the cationic softener since there is a tendency for the viscosity of the nonionic to increase when mixed with cold water forming a gel.

In British application 2053249A published Feb. 4, 1981, there are disclosed cationic fabric softening compositions containing 15 to 60% by weight of cationic softener, 25 to 75% by weight of an aqueous medium and 0.5 to 40% by weight of a specified water soluble polymer.

In U.S. Pat. No. 4,351,737 concentrated fabric softeners are described containing both cationic and non-ionic softeners and a non-ionic dispersing agent along with a solvent mixture of a $C_1$ to $C_3$ alkanol and a liquid glycol, polyglycol or an alkyl ether thereof. Hexylene glycol is not disclosed.

It has now been found that the dispersibility in cold water and the flow from automatic dispensers, even in highly concentrated, nonionic surfactant-containing liquid fabric softener compositions can be improved considerably by replacing part or all of the conventional liquid carrier of the non-aqueous liquid softener composition by hexylene glycol.

SUMMARY OF THE INVENTION

The present invention provides substantially non-aqueous stable, concentrated softener compositions based upon quaternary ammonium softening compounds and a carrier liquid comprising hexylene glycol and optionally a nonionic surfactant. The present invention also provides a method by which highly concentrated fabric softening compositions are produced and used.

DETAILED DESCRIPTION OF THE INVENTION

The compositions of the present invention are stable substantially non-aqueous compositions which contain a high concentration of the cationic fabric softener which is a water dispersible quaternary ammonium compound as hereinafter described and hexylene glycol as the, or as part of the, liquid carrier. Preferred compositions may also include non-ionic surfactant and electrolyte.

The compositions of this invention contain at least about 20% cationic softener and up to about 80% thereof, preferably up to about 70% and more preferably up to about 60% of cationic softener said cationic softener having the general formula:

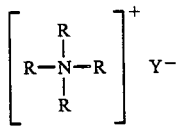

I.

wherein the R group are selected from $C_1$ to $C_{30}$ aliphatic, preferably alkyl or alkenyl, aryl (e.g. phenyl, tolyl, cumyl, etc.); aralkyl (e.g. benzyl, phenethyl, etc.); and the halo, amide, hydroxyl, and carboxyl substituents thereof; with the proviso that at least one R is $C_{14}$ to $C_{30}$ and preferably $C_{14}$ to $C_{18}$, and the others are lower alkyl, and more preferably at least two R's are $C_{14}$ to $C_{18}$ and the others are lower alkyl of $C_1$ to $C_4$ (and most preferably methyl or ethyl), or hydroxyalkyl (i.e. $(CH_2—CH—O)_xH$ where x is 1 to 10, preferably 1 to 5, most preferably 1 or 2 and $R_1$ is hydrogen or $C_1$ to $C_4$ alkyl, and Y is a water-solubilizing anion such as chloride, bromide, iodide, fluoride, sulfate, methosulfate, nitrite, nitrate, phosphate and carbosylate (i.e. acetate, adipate, propionate, phthalate, benzoate, oleate, etc.). Typical cationics of fomula I include the following:

distearyl dimethyl ammonium chloride
ditallow dimethyl ammonium chloride
dihexadecyl dimethyl ammonium chloride distearyl dimethyl ammonium bromide di(hydrogenated tallow) dimethyl ammonium bromide ditallow isopropyl methyl ammonium chloride distearyl di(isopropyl) ammonium chloride distearyl dimethyl ammonium methosulfate.

A highly preferred class of cationics is of Formula I wherein two of the R groups are $C_{14}$ to $C_{18}$, one R is methyl, or ethyl and one R is methyl, ethyl, isopropyl, n-propyl, hydroxyethyl or hydroxypropyl.

Other quaternary softeners which can be used include compounds of the Formula IIa and IIb.

IIa.

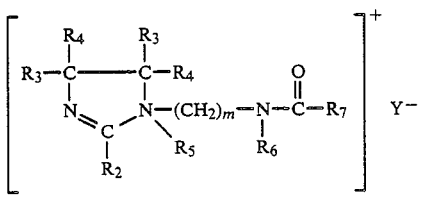

or

IIb.

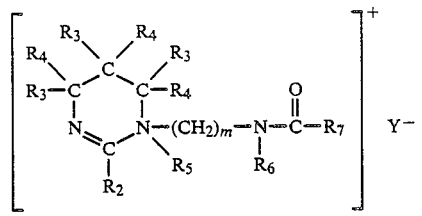

wherein $R_2$ is $C_6$ to $C_{30}$, preferably $C_8$ to $C_{18}$, alkyl or alkenyl;

$R_3$ and $R_4$ are independently hydrogen or $C_1$ to $C_4$ alkyl;

$R_5$ is $C_1$ to $C_4$ alkyl;

$R_6$ is hydrogen or $C_1$ to $C_4$ alkyl;

$R_7$ is $C_6$ to $C_{30}$, preferably $C_8$ to $C_{18}$ alkyl; and m is 2 or 3.

Illustrative compounds of Formula IIa include:

1-methyl 1-((tallowylamido-) ethyl) -2-talloyl 4,5 dihydro imidazolinium methyl sulfate; 1-methyl-1 ((palmitoylamido) ethyl) 2-octadecyl- 4,5 dihydroimidazolinium chloride.

Specifically preferred cationics are: ditallow monomethyl monohydroxypropyl ammonium chloride, distearyl dimethylammonium chloride, ditallow dimethylammonium chloride, ditallow isopropyl methyl ammonium chloride, etc.

The non-aqueous carrier may comprise from about 80% to about 20%, preferably from about 60% to about 25%, by weight of the composition.

The non-aqueous carrier of the composition of this invention comprises at least about 25% and preferably at least 30% of hexylene glycol and the balance a $C_1$ to $C_3$ alkanol, preferably ethanol or propanol, a $C_2$ to $C_6$ glycol, preferably diethylene glycol or propylene glycol, or a $C_1$ to $C_6$ mono- or di-alkyl ether of such glycols or mixtures thereof. The entire carrier may consist of hexylene glycol to the exclusion of the alcohols and/or glycols (and/or glycol ethers). Hexylene glycol is the commercial name for 2-methylpentane-2,4-diol.

Typical carriers may comprise (a) 25% hexylene glycol and 75% propylene glycol; (b) 31% hexylene glycol and 69% propylene glycol; (c) 31% isopropanol and 69% hexylene glycol; (d) 100% hexylene glycol.

The total amount by weight of the cationic fabric softener and the non-aqueous liquid carrier in the composition will be at least about 80 and up to 100%, preferably from about 85% to 99% by weight, the balance including the nonionic surfactant, electrolyte and/or optional conventional additives.

The optional non-ionic component of the present composition comprises from about 0 to about 15%, preferably from about 1 to 12%, by weight of the composition and generally may vary with the cationic softener in a weight ratio of cationic to nonionic of from about 25:1 to about 3:1, preferably from about 12:1 to 6:1 and especially preferably about 10:1. Suitable nonionic compounds include ethylene oxide and propylene (and mixtures thereof) condensates of $C_8$ to $C_{20}$ aliphatic alcohols and mono, di- and tri-alkyl (each $C_4$ to $C_{12}$) phenols. Generally, the non-ionics preferred herein are moderately hydrophilic in nature with a moderate hydrophilic group. In the present invention, this group is preferably an oxyethyl chain generally of at least about 2 terminal oxyethyl groups (i.e. the oxyethyl groups are contigous and terminate in an hydroxyl group) with no more than about 20 such groups, although there may be as many as 200 moles oxyethylene per mole of the hydrophobic group.

Particularly suitable non-ionic surfactants include a $C_{9-11}$ aliphatic alcohol containing 8 moles of condensed ethylene oxide; an ethoxylated nonyl phenol with 6 moles of ethylene oxide, an ethoxylated octyl phenol with 4.5 moles of ethylene oxide and a $C_9$ aliphatic alcohol with 7.5 moles ethylene oxide.

In addition to the foregoing components of the softening compositions of this invention, there may also be included numerous conventional, supplemental, and optional ingredients which do not adversely affect the stability and/or functional characteristics of the instant compositions. Thus, for example, there may be present the ubiquitous perfumes, dyes, pigments, opacifiers, germicides, optical brighteners, anti-corrosion agents (e.g. sodium silicate), polymers, anti-static agents and the like. Where used, each may comprise, for example, from 0.01% to about 5% by weight of the composition.

It is, of course, recognized and understood that most available chemical materials and particularly those containing an hydrocarbyl moiety are generally mixtures of closely related moieties. Thus, the long chain alkyl substituents (R) in the cationics used in this invention may not only be a single length carbon chain but more likely a mixture. In this regard, a particularly useful quaternary salt, wherein the alkyl groups are derived from tallow, may contain about 35% $C_{16}$ and 60% $C_{18}$ and minor amounts of $C_{14}$ and even others. Similarly, the aliphatic alcohol percursors for the non-ionics used herein may be of a single carbon chain length but more likely, again, it will and can be a mixture in any proportion of the operable chain length compounds.

The fabric softening compositions of this invention should have viscosities in the range of about 10 to 250 centipoises and preferably 25 to 150 centipoises in addition to their essential water-dispersibility in the rinse cycle (or any other form of dilution prior to use).

The manner of combining the hexylene glycol, other optional carriers, cationic softener and optional nonionic surfactant, electrolyte, and other optional conventional additives is not particularly critical, nor is the order of addition. However, some degree of care should be taken to avoid excessive heating in order to limit solvent evaporation and, more importantly, to stay below the flash point temperature of the carrier and any other low boiling liquids that may be present or brought in as components of the softener and the like. For example, the flash point for hexylene glycol is 93° C. Generally, however, it is preferred to combine all of the ingredients at room temperature, e.g. form about 15° C. to 25° C., or lower.

A suitable procedure for preparing the compositions of this invention involves dissolving any nonionic and other additives (e.g. brightener, color, perfume, etc.) in the carrier and then adding this mixture to the cationic which preferably is in liquid form, e.g. as a dispersion in the carrier of any component thereof (for example, as a dispersion in isopropanol).

The following examples will serve to illustrate the present invention without being deemed limitative thereof. Parts are by weight unless otherwise indicated.

EXAMPLE 1

Following the procedure described above, 2 parts of an ethoxylated nonyl phenol (containing 6 moles of ethylene oxide) are dissolved in about 75 parts of hexylene glycol at a temperature of about 20° C. To this solution are slowly added 20 parts of distearyl dimethyl ammonium chloride (75% active in isopropanol) with stirring. A stable product results with a viscosity of about 100 cps.

EXAMPLE 2

The procedure of Example 1 is repeated utilizing the following parts of (A) cationic (active), (B) surfactant, (NaCl); and (C) hexylene glycol (a) A=22; B=2.0; C=76.0
(b) A=34; B=3.5; C*=62.5
(c) A=46; B=4.8; C=49.2
(d) A=58; B=5.5; C=36.5

*hexylene glycol/ethylene glycol at 3:1 weight ratio

EXAMPLE 3

Examples 1 and 2 are repeated utilizing in place of distearyl dimethyl ammonium chloride the following:

(a) ditallow dimethyl ammonium chloride
(b) distearyl dimethyl ammonium methosulfate
(c) di(hydrogenated tallow) dimethyl ammonium bromide
(d) di-hexadecyl dimethyl ammonium chloride
(e) distearyl diethyl ammonium chloride.
(f) 1-methyl-1-((tallowylamido)ethyl)-2-tallowyl-4,5-dihydroimidazolinium methyl sulfate.

EXAMPLE 4

In order to demonstrate the improved dispensibility of the hexylene glycol based liquid carrier for the concentrated softening compositions the following formulations A–E are prepared:

| | Weight % |
|---|---|
| Solvent (A–E) | 31.9 |
| Cationic fabric softener[1/] | 60.0 |
| Nonionic[2/] | 5.0 |
| Perfume, dye, minors | 3.1 |

[1/] 75% A.I. in isopropanol
[2/] nonyl phenol ethoxylated with an average of 6 moles ethylene oxide (C-9 phenol EO6:1)

The following are used as the solvent:

A - 10% isopropyl alcohol and 21.9% diethylene glycol (comparison)

B - 10% hexylene glycol and 21.9% propylene glycol

C - 10% isopropyl alcohol and 21.9% hexylene glycol

D - 31.9% hexylene glycol

E - 31.9% propylene glycol (comparison)

Each of the above softener formulations are added to the dispenser of a typical European washing machine. AEG-802, and after 3 cumulative up-to-boil cycles, (the dispenser being refilled for each cycle), the amount of the formulation remaining in the dispenser is measured. The results are shown in the following table as a percent of the total amount used (i.e. a triple dose):

| Formulation | Solvent | Quantity Remaining (%) |
|---|---|---|
| A | 10% isopropanol<br>21.9% diethylene glycol | 15 |
| B | 10% hexylene glycol<br>21.9% propylene glycol | 6.7 |
| C | 10% isopropanol<br>21.9% hexylene glycol | 3.6 |
| D | 31.9% hexylene glycol | 2.8 |
| E | 31.9% propylene glycol | 19 |

From the above results, it can be easily appreciated that the use of hexylene glycol in place of all or part of the conventional non-aqueous liquid carriers for rinse cycle added fabric softener formulation greatly improves the cold water dispersibility and flow (dispensibility), even of concentrated formulations containing nonionic surfactants.

Moreover, the concentrated liquid fabric softener compositions of this invention are stable for long periods of time at both low, e.g. 4° C. and high, e.g. 35° C. storage temperatures, including freeze-thaw cycles, over periods of 6 weeks and longer.

The compositions of this invention have the further advantage that hexylene glycol is non-toxic and, therefore, the formulations are safe to use.

While the instant compositions are intended primarily for direct use in the rinse cycle of automatic washing machines they can also be used in diluted form and for manual treatment, both in and out of the washing machine.

Still further, it should be understood that as used herein, the term "non-aqueous" means that no water is intentionally added to the system, although minor amounts of water, e.g. up to about 5%, can be present, based on addition of specific ingredients, e.g. dyes, as aqueous solutions, the water contained in the softener, etc.

What we claim is:

1. A stable substantially non-aqueous, concentrated fabric softening composition consisting essentially of about 20 to 80% of a water dispersible quaternary ammonium compound cationic softener (A), about 80 to 20% by weight of a non-aqueous carrier liquid, said carrier liquid comprising at least 25% by weight of hexylene glycol, and about 1 to 15% by weight of nonionic surfactant (C), wherein the cationic softener (A) is selected from the group consisting of compounds of the formula (IIa) or (IIb):

(IIa)

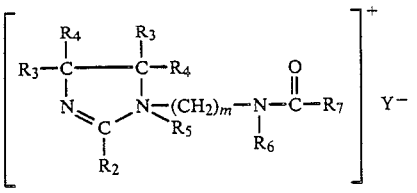

(IIb)

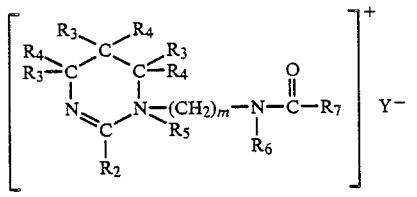

wherein $R_2$ is $C_6$ to $C_{30}$ alkyl or alkenyl, $R_3$ and $R_4$ are, independently, hydrogen or $C_1$ to $C_4$ alkyl; $R_5$ is $C_1$ to $C_4$ alkyl; $R_6$ is hydrogen or $C_1$ to $C_4$ alkyl; $R_7$ is $C_6$ to $C_{30}$ alkyl; m is 2 or 3; and Y is a water-solubilizing anion.

2. A stable substantially non-aqueous, concentrated fabric softening composition consisting essentially of about 20 to 80% of a water dispersible quaternary ammonium compound cationic softener (A), about 80 to 20% by weight of a non-aqueous carrier liquid, said carrier liquid comprising at least 25% by weight of hexylene glycol, and about 1 to 15% by weight of nonionic surfactant (C), wherein the cationic softener (A) is selected from the group consisting of compounds of the formula (I)

(I)

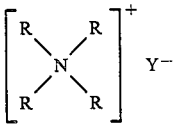

wherein two of the R's are selected from the group consisting of ditallow, distearyl, dihexydecyl and dihydrogenated tallow; and the other two R's are selected from the group consisting of methyl, hydroxypropyl, isoproplyl, ethyl and $$-(CH_2\underset{\underset{R_1}{|}}{C}HO)_xH$$

where x is 1 to 5 and $R_1$ is hydrogen or $C_1$ to $C_4$ alkyl, and Y is a water soluble anion.

3. The composition of claim 1 or 2 wherein the weight ratio of cationic fabric softener to nonionic surfactant is from about 25:1 to about 3:1.

4. The composition of claim 1 or 2 wherein the non-aqueous carrier (B) comprises at least 35% by weight of hexylene glycol.

5. The composition of claim 1 or 2 wherein the non-aqueous carrier consists of hexylene glycol.

6. The composition of claim 1 or 2 wherein the non-aqueous carrier comprises a mixture containing at least 25% by weight of hexylene glycol and the balance being a $C_1$ to $C_3$ alkanol, a $C_2$ to $C_6$ glycol, a $C_1$ to $C_6$ mono- or di-alkyl ether of said glycol, or mixtures thereof.

7. The composition of claim 1 or 2 wherein said non-aqueous carrier is comprised of (a) 25% hexylene glycol and 75% propylene glycol; (b) 31% hexylene glycol and 69% propylene glycol; (c) 31% isopropanol and 69% hexylene glycol; or (d) 100% hexylene glycol.

8. The composition of claim 1 or 2 wherein the nonionic surfactant is an ethylene or propylene or mixtures thereof, oxide condensate of $C_8$–$C_{20}$ aliphatic alcohol or a mono-, di-, tri-alkyl phenol, each of said alkyl groups containing from 4 to 12 carbon atoms.

9. The composition of claim 8 wherein said condensate comprises from about 2 to about 20 moles ethylene oxide per mole of alcohol or pheonl.

10. The composition of claim 1 or 2 wherein the nonionic surfactant is selected from the group consisting of $C_{9-11}$ aliphatic alcohol containing 8 moles of condensed ethylene oxide, an ethoxylated nonyl phenol with 6 moles of condensed ethylene oxide, an ethoxylated nonyl phenol with 6 moles of ethylene oxide, an ethoxylated octyl phenol with 4.5 moles of ethylene oxide and a $C_9$ aliphatic alcohol with 7.5 moles of ethylene oxide.

11. A method for imparting softness to fabrics which comprises adding the composition of claim 1 to an aqueous media containing the fabrics in an amount to provide a concentration of the cationic of from about 0.005% to 0.5% based on the weight of the fabrics.

12. The method of claim 11 wherein the composition is added to the aqueous media during the rinse cycle of an automatic washing machine by flowing a stream of cold water onto the composition whereby the composition is dispersed in the flowing stream and then transferred to the aqueous media.

13. A method for imparting softeners to clothes which comprises diluting the composition of claim 1 or 2 with from about 4 to 15 times as much water by volume as the composition of claim 28 or 30 and then adding the diluted composition to the clothes.

14. A method for imparting softness to fabrics which comprises adding the composition of claim 2 to an aqueous media containing the fabrics in an amount to provide a concentration of the cationic of from about 0.005% to 0.5% based on the weight of the fabrics.

15. The method of claim 14 wherein the composition is added to the aqueous media during the rinse cycle of an automatic washing machine by flowing a stream of cold water onto the composition whereby the composition is dispersed in the flowing stream and then transferred to the aqueous media.

16. A stable substantially non-aqueous, concentrated fabric sottening composition consisting essentially of about 20 to 80% of a water dispersible quaternary ammonium compound cationic softener (A), about 80 to 20% by weight of a non-aqueous carrier liquid, said carrier liquid comprising at least 25% by weight of hexylene glycol, and about 1 to 15% by weight of nonionic surfactant (C), wherein the cationic softener (A) is selected from the group consisting of 1-methyl 1- (tallowylamido) ethyl) -2 talloyl 4,5 dihydro imidazolinium methyl sulfate; and 1-methyl-1(palmitoylamido)ethyl) 2-octadecyl-4,5 dihydroimidazolinium chloride.

17. A stable substantially non-aqueous, concentrated fabric softening composition consisting essentially of about 20 to 80% of a water dispersible quaternary ammonium compound cationic softener (A), about 80 to 20% by weight of a non-aqueous carrier liquid, said carrier liquid comprising at least 25% by weight of hexylene glycol, and about 1 to 15% by weight of nonionic surfactant (C), wherein the cationic softener (A) is selected from the group consisting of ditallow monomethyl monohydroxypropyl ammonium chloride, distearyl dimethylammonium chloride, ditallow dimethylammonium chloride and ditallow isopropyl methyl ammonium chloride.

18. A stable substantially non-aqueous, concentrated fabric softening composition consisting essentially of about 20 to 80% of a water dispersible quaternary ammonium compound cationic softener (A), about 80 to 20% by weight of a non-aqueous carrier liquid, said carrier liquid comprising at least 25% by weight of hexylene glycol, and about 1 to 15% by weight of nonionic surfactant (C), wherein the cationic softener (A) is selected from the group consisting of dihexadecyl dimethyl ammonium chloride, distearyl dimethyl ammonium bromide, di(hydrogenated tallow) dimethyl ammonium bromide, distearyl di(isopropyl) ammonium chloride, distearyl dimethyl ammonium methosulfate and distearyl diethyl ammonium chloride.

19. A method for imparting softening to fabrics which comprises adding a stable substantially non-aqueous, concentrated fabric softening composition consisting essentially of about 20 to 80% of a water dispersible quaternary ammonium compound cationic softener (A), about 80 to 20% by weight of a non-aqueous carrier liquid, said carrier liquid comprising at least 25% by weight of hexylene glycol, and about 1 to 15% by weight of nonionic surfactant (C), wherein the cationic softener (A) is selected from the group consisting of 1-methyl 1-(tallowylamido-) ethyl) -2 talloyl 4,5 dihydro imidazolinium methyl sulfate, and 1-methyl-1(palmitoylamido)ethyl) 2- octadecyl- 4,5 dihydroimidazolinium chloride to an aqueous media containing the fabrics in an amount to provide a concentration of the cationic of from about 0.005% to 0.5% based on the weight of the fabrics.

20. A method for imparting softness to fabrics which comprises adding a stable substantially non-aqueous, concentrated fabric softening composition consisting essentially of about 20 to 80% of a water dispersible quaternary ammonium compound cationic softener (A), about 80 to 20% weight of a non-aqueous carrier liquid, said carrier liquid comprising least 25% by weight of hexylene glycol, and about 1 to 15% by weight nonionic surfactant (C), wherein the cationic softener (A) is selected from the group consisting of ditallow monomethyl monohydroxypropyl ammonium chloride, distearyl dimethylammonium chloride, ditallow dimethylammonium chloride and ditallow isopropyl methyl ammonium chloride to an aqueous media containing the fabrics in an amount to provide a concentration of the cationic of from about 0.005% to 0.5% based on the weight of the fabrics.

21. A method for imparting softness to fabrics which comprises adding a stable substantially non-aqueous, concentrated fabric softening composition consisting essentially of about 20 to 80% of a water dispersible quaternary ammonium compound cationic softener (A), about 80 to 20% weight of a non-aqueous carrier liquid, said carrier liquid comprising least 25% by weight of hexylene glycol, and about 1 to 15% by weight nonionic surfactant (C), wherein the cationic softener (A) is selected for the group consisting of dihexadecyl dimethyl ammonium chloride, distearyl dimethyl ammonium bromide, di(hydrogenated tallow) dimethyl ammonium bromide, distearyl di(isopropyl) ammonium chloride, distearyl dimethyl ammonium methosulfate and distearyl diethyl ammonium chloride to an aqueous media containing the fabrics in an amount to provide a concentration of the cationic of from about 0.005% to 0.5% based on the weight of the fabrics.

* * * * *